United States Patent [19]

Wilkes

[11] 4,203,366

[45] May 20, 1980

[54] FM FUZE CIRCUIT

[75] Inventor: Gilbert Wilkes, Gerrardstown, W. Va.

[73] Assignee: The United States of America as represented by the Secretary of the Navy, Washington, D.C.

[21] Appl. No.: 637,846

[22] Filed: Feb. 1, 1957

[51] Int. Cl.[2] ..... F42C 13/04

[52] U.S. Cl. ..... 102/214

[58] Field of Search ..... 102/70.2, 211–214; 343/14, 17.2, 17.5, 7.3, 9, 10, 12, 11, 13

[56] References Cited

U.S. PATENT DOCUMENTS

| | | | |
|---|---|---|---|
| 2,536,327 | 1/1951 | Tolson | 102/211 |
| 2,557,864 | 6/1951 | Doremus | 343/14 |
| 2,618,744 | 11/1952 | Braden | 343/14 |
| 2,688,131 | 8/1954 | Kiebert | 343/14 |
| 2,700,156 | 1/1955 | Sunstein | 343/14 |
| 2,738,502 | 3/1956 | Armstrong | 343/14 |

OTHER PUBLICATIONS

"Proximity Fuzes for Artillery", Harner Selvidge, *Electronics Magazine*, pp. 104–109, Feb. 1946.

*Primary Examiner*—Charles T. Jordan

*Attorney, Agent, or Firm*—R. S. Sciascia; A. L. Branning

EXEMPLARY CLAIM

1. A microwave proximity fuze for a missile, comprising, a radio transmitting-receiving system including a waveguide having at one end a klystron with a repeller electrode and an antenna at the other end thereof, means including a square wave modulator for sending a predetermined sequence of voltage pulses to the repeller of said klystron to produce corresponding but well-defined frequency changes in the output signals from said klystron, said output signals being transmitted through said waveguide and radiated by said antenna into free space and intercepted and reflected back to said antenna by a target, a pair of directional couplers, one of said couplers being responsive only to transmitted signals and the other said coupler being responsive to received signals reflected from said target, means including a balanced mixer having its input channels connected to receive said signals from said couplers, means including crystal detectors mounted in the output channels of said balanced mixer, means including an intermediate frequency amplifier for receiving the output signals from said crystal detectors, means including a diode for receiving a unidirectional voltage signal from said intermediate frequency amplifier, an auxiliary detector, a third directional coupler associated with said waveguide for transmitting outgoing signals to said auxiliary detector, said auxiliary detector producing a rectified transmitted signal, means including a gate electrically associated with said auxiliary detector and said diode as well as said square wave modulator to give a negative bias on the cathode of said diode, said bias on said cathode of said diode being determined jointly by the voltage derived from the rectified transmitted signal from said auxiliary detector and the voltage from said square wave modulated, and a firing circuit for said fuze including a squib and a thyratron tube having an anode, a cathode and a control grid for also receiving said negative bias, said thyratron causing detonation of said squib whenever the negative bias of said control grid becomes reduced sufficiently to permit a discharge to occur between its anode and cathode.

6 Claims, 3 Drawing Figures

FIG. 1.
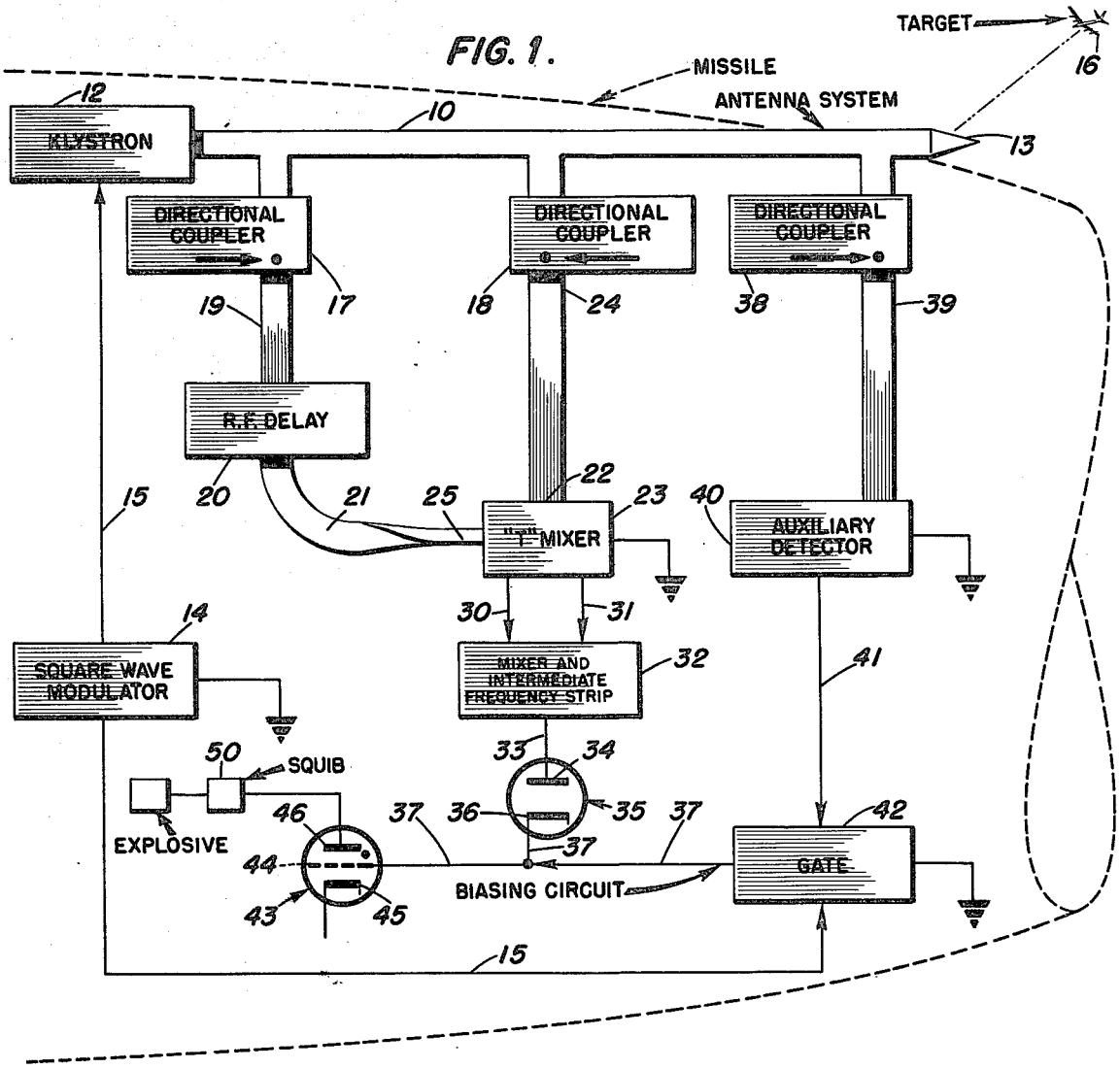
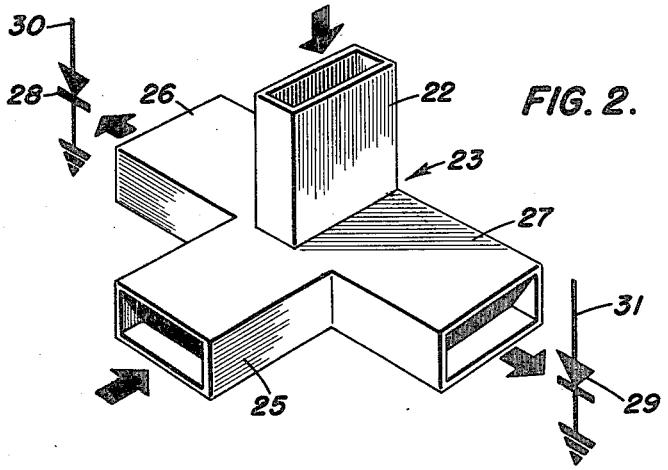
FIG. 2.

FM FUZE CIRCUIT

The present invention relates generally to proximity fuzes for use with guided missiles, and more particularly it pertains to an improved microwave circuit for frequency modulation operation in a proximity fuze.

In conventional proximity fuze circuits, an oscillator in the fuzed missile continually emits signals, and upon approaching a target, signal reflection occurs, thus producing a beat frequency between the emitted and reflected signals due to the Doppler frequency shift engendered by the relative motion of fuzed missile and target.

In radio proximity fuzes, the intensity of the emitted signal at the target is proportional to the inverse square of the distance from fuzed missile to target, and with the usual relatively small solid angle subtended by the target, the intensity of the reflected signal at the fuzed missile is in turn also proportional to the inverse square, with the result that the intensity of the reflected signal at the fuzed missile is proportional to the product of the two inverse squares, that is, to the inverse fourth power of said distance or range.

When the intensity of the reflected signal is plotted with respect to the range to the target, there results a curve whose slope is too small, at the usual target range, to yield a satisfactorily close sharpness of definition of the range at which the fuze responds, and it is therefore desirable to provide a proximity fuze that depends on parameters that yield improved performance in this respect.

Furthermore, the development of relatively expensive missiles requires that the probability of effecting destruction of the target with one missile be made maximum. This has led to the development of warheads with highly directional burst patterns. The fuze must then be made to respond to a target only when the burst has the maximum chance of doing damage. The fuze pattern then should be of the same nature as that of the burst, and this is obtainable practically only by using shorter wavelength radiation than used hitherto in fuze work.

An object of the present invention, therefore, is to provide a microwave proximity fuze circuit that may be designed to respond within closer limits to the target range and position, so that the position most effective for target destruction may be utilized.

Another object is to provide a frequency-modulated fuze which has a sharply definable range.

Other objects and advantages of this invention will become evident from the following detailed description and the accompanying drawings, wherein:

FIG. 1 is a block diagram illustrating the circuit used in the invention;

FIG. 2 shows details of the "T" mixer forming part of the circuit illustrated in FIG. 1.

Figure 3:
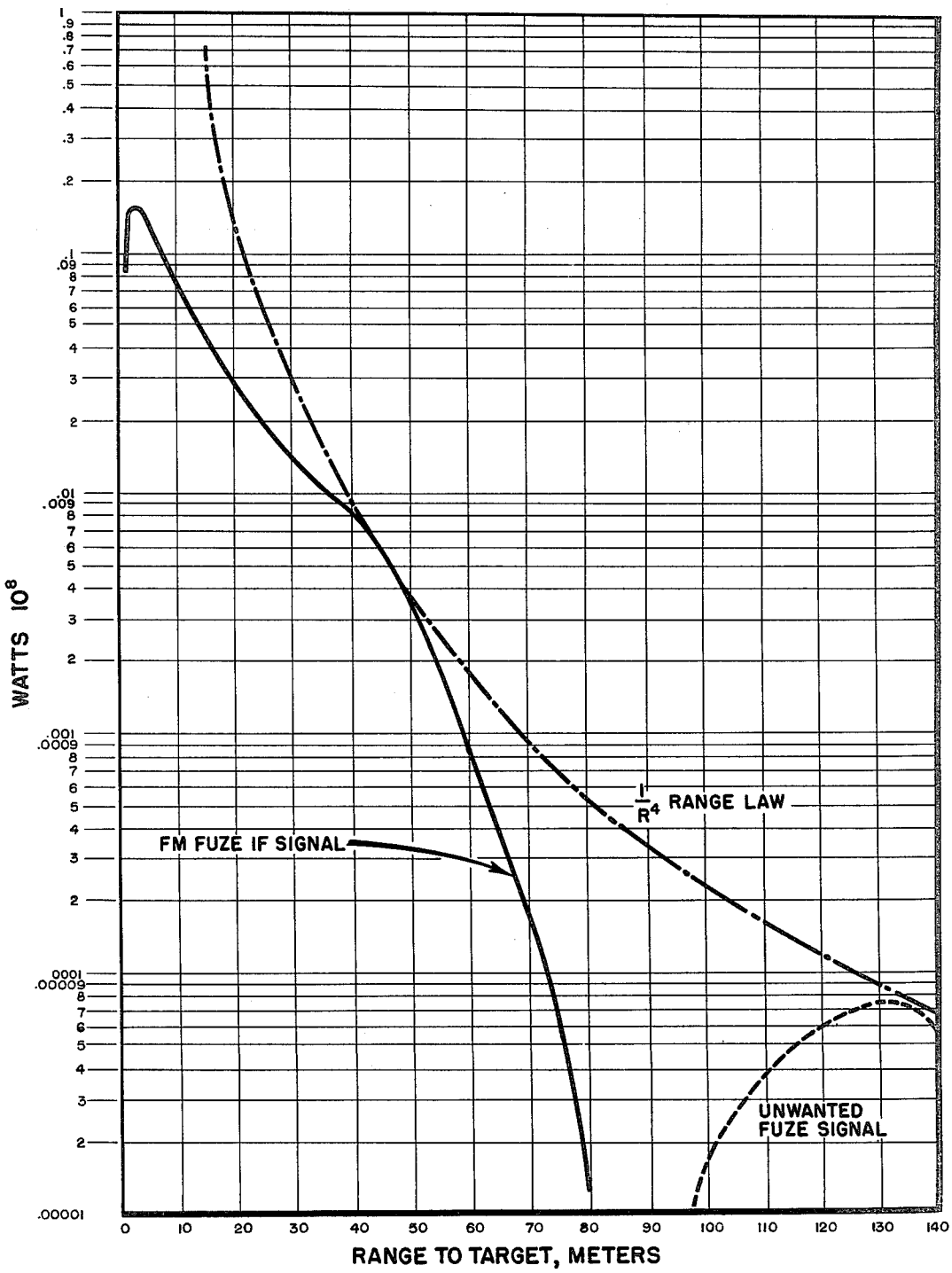
FIG. 3 is a graphical representation of the calculated fuze signal versus range of the missile to the target.

In a fuze for a missile, it is desirable to obtain triggering of the fuze at a well defined distance from the target. This definition should be greater than that obtainable from the inverse fourth power of distance law governing the strength of reflected signals from the target.

It is also desirable to have triggering of the fuze occur at an optimum aspect to the target, depending on the directional properties of the particular warhead used. This desirable feature is obtainable by having the radiant energy pattern for the fuze bear a certain relationship to the burst pattern of the warhead, and by further controlling the burst time of the warhead as a function of the target and missile speeds and other parameters.

This requirement, therefore, results in a directional radiator for the fuze, which dictates the use of fairly short wavelengths.

It is known that the signal available from an IF strip in which pulses of two frequencies are opposed is a rather sharp function of the number of IF cycles contained in the time that two pulses overlap, or is a sharp function of the IF pulse duration.

Accordingly, the present invention includes frequency modulating a klystron, in a step fashion, then in radiating the frequency modulated signal against a target. The reflected pulses of one frequency reflected from the target are then compared with transmitted pulses of the other frequency to obtain an IF frequency pulse.

Thus, the target is made to operate as a source of radiation of a given frequency, fixed by the klystron of the fuze. After a suitable time delay, the frequency of the klystron is stepped down to operate a superheterodyne receiver on the combination of the transmitted and reflected signals.

As the time of arrival of the reflected pulse is a function of range, the time during which the transmitted and reflected signals overlap, the IF pulse duration, is also a function of range. The number of IF cycles contained in a pulse is, therefore, a function of range and this number affords the sharp range definition which is required in the fuze.

The electrical circuits of the individual units incorporated in the present invention are not illustrated and will not be described in detail, since they are well known in the art.

Referring first to FIG. 1 of the drawing, there is shown a radio transmitting-receiving system comprising a wave guide 10 having a klystron 12 at one end thereof and an antenna 13 at its other end. Suitable power sources (not shown) for energizing the klystron 12 are connected thereto.

A square wave modulator 14 including a multivibrator is provided for sending a predetermined sequence of voltage pulses (that is, pulses of higher and lower voltages) through lead 15 to the repeller of the klystron 12, for example, two or more stepped voltages, whereby corresponding slight but well-defined frequency changes in the klystron output are produced. This output is transmitted through wave guide 10 and antenna 13 into free space, with the intent that a portion thereof will be intercepted by the prospective target 16 and reflected back to the antenna 13, whence it will return through the wave guide 10.

Two directional couplers 17 and 18, pointed in opposite directions, are provided, whereby the coupler 17 responds only to the outgoing or transmitted oscillations generated by the klystron 12, while the coupler 18 on the contrary responds only to received signals reflected from the target 16 and thus travelling through wave guide 10 in the opposite direction.

The energy collected by coupler 17 passes through a wave guide 19, an optionally provided radio frequency delay device 20, and a wave guide 21, to one input channel 25 of a "magic T" mixer 23, while the energy collected by coupler 18 passes through a wave guide 24 to the other input channel 22 of the mixer 23.

This magic T mixer 23, which is known per se, is illustrated in detail in FIG. 2. It is made of intercommunicating sections of wave guide and comprises the two input channels 22 and 25, and the two output channels 26 and 27, which are constructed and connected as shown. Crystal detectors 28 and 29 are located in the output channels 26 and 27, respectively, and are connected in push-pull through leads 30 and 31 to the mixer and intermediate frequency strip 32 whose output is fed through lead 33 to the anode 34 of a biased diode 35.

The mixer 23 illustrated in FIG. 2 is of the balanced type and will be recognized by those versed in the art. It will be readily understood that simpler mixers could also be used, but the one illustrated is preferred because of the following considerations: Any generated signal fed through sequential guides 19, 21 and 25 is split into identical parts in wave guides 26 and 27. Now if crystals 28 and 29 have been matched, in the absence of any target 16, the signals they will transmit are completely cancelled out in the push-pull transformer feeding the intermediate frequency amplifier 32. While the frequency of the signals thus obtained would ordinarily be very much greater than the tuned intermediate frequency, still the frequency pulsing of the klystron may cause the generation of a minute amount of unwanted frequencies or noise, some of which might lie within the filter band pass. The use of the balanced mixer 23 eliminates the effect of this unwanted generated noise.

In mixer 23 the received oscillations are heterodyned with the outgoing oscillations to provide oscillations of intermediate frequency in each instance, as is well known in superheterodyne receivers. After rectification by the detectors 28 and 29, and passage through the second mixer and intermediate frequency strip 32, the final result is a voltage which will produce unidirectional current pulses through the diode 35 whenever the voltage is high enough to overcome the negative bias of cathode 36.

The bias is applied through lead 37 and is derived as will now be explained. A directional coupler 38, associated with wave guide 10, and responsive to the transmitted (outgoing) signals, feeds energy through a waveguide 39 to an auxiliary detector 40. The rectified output of the detector 40 passes through a lead 41 to a gate 42 which is also connected to the lead 15 coming from the square wave modulator 14. Thus the bias is determined jointly by the voltage derived from the rectified transmitted signal and the square wave modulator voltage.

The bias voltage supplied through lead 37 is fed also to the control grid 44 of the thyratron 43. This thyratron 43 is in the firing circuit of the fuze, and will cause detonation of a conventional squib 50 whenever the bias of grid 44 becomes reduced sufficiently to permit a discharge to occur between the anode 46 and the cathode 45.

It will be understood that the actual firing circuits may include fast means to secure detonation, such as a charged capacitor which would be discharged through the squib 50 when the thyratron 43 is made conducting. The squib 50, in turn, will explode a booster and an explosive 52 in the warhead. This and the conventional safety circuits and delay circuits are not shown, as they are not parts of the present invention.

The operation of the invention will now be explained. The klystron 12 continuously generates oscillations, but not of constant frequency. Due to the voltage pulses fed to the repeller of klystron 12 by the square wave modulator 14, assumed to consist of a plurality of distinct voltages, repeated indefinitely in the same sequence, a corresponding periodic sequence of sets of oscillations of different frequencies will be generated by the klystron 12 and emitted by the antenna 13.

The sets of oscillations are radiated in sequence against the target 16, and their incoming reflections are then heterodyned with the outgoing oscillations, thus producing oscillations of intermediate frequency from the outgoing oscillations of one of the frequencies and the reflections of another frequency.

Let it be assumed, for simplicity, that only two voltages are fed to the repeller of the klystron 12 from the square wave generator 14, and that they are such that the oscillations of frequencies $f_1$ and $f_2$ correspondingly produced by the klystron will be respectively 9280 and 9320 megacycles per second. In comparison with frequencies of this order of magnitude, it will at once be clear that the Doppler frequencies, produced by the relative velocity of missile and target 16, will be negligible and hence that all Doppler effects may safely be ignored. The new fuze thus is independent of such Doppler effects, which in the conventional proximity fuze are relied on for control, and hence is of an entirely different type.

Assume now that sets of oscillations of frequencies $f_1$ and $f_2$ are emitted continuously and consecutively in that sequence from the fuze to the target 16, and each in turn for a time T. The reflections will consequently likewise consist of such sets of oscillations, with their frequencies the same as those emitted by the fuze, and following one another in the same sequence.

The interactions between emitted and reflected oscillations will now be considered. If the range to the target 16 is such that the total time required by the travel of the radiation to the target and back to the fuze is the same as (or an integral multiple of) the total emission time (2T) required by the sequence of the two frequencies, obviously each outgoing set will coincide with the reflection of the preceding set of the same frequency, and therefore no heterodyning will take place at the source and no intermediate frequency (IF) will be produced.

As the range varies during the flight of the missile, a progressive change takes place in the duration of the intermediate frequency sets, because of the change in time of travel from missile to target 16 and back. Thus, if the range is such that this total time is equal to the complete cycle or period of the square wave modulator, sets of reflections will always meet corresponding sets of the outgoing signals of corresponding frequency, so that no heterodyning or IF effect will ensue.

Hence, with the range equal to any integral multiple of the "wave length" of the square wave modulator, no IF signal results. On the contrary, for a range equal to a half wavelength or any odd multiple thereof, IF pulses will be produced in sets of maximum duration. Between these two extremes the amount of overlap of emitted and received sets of oscillations will likewise vary from zero to a maximum, as a linear function of range.

Specifically, assume that the range to the target 16 is small so that the time of arrival of the return signal may be measured by a time $\Delta t$ less than T. Two pulses of IF frequency, each of duration $\Delta t$, will occur in mixer 23, the one of frequency $f_2-f_1$ occurring during the transmission of $f_2$, and the second, of the same frequency, occurring during the transmission of $f_1$. If gate 42 is set to eliminate the effect of the second of these pulses, the diode 35 will pass to the thyratron 43 only the first one. Its duration is $\Delta t$, and its frequency $f_2-f_1$ is constant.

For very short ranges its duration $\Delta t$ will contain only a very small number of IF cycles.

Let N be this number. It is known by those skilled in the art that the amount of energy passed by an IF strip and filter of bandwidth $4\pi\Delta f$, centered on a frequency $2\pi(f_2-f_1)$, will be to the energy contained in the original pulse approximately in the ratio of $$\left[\frac{4\pi\Delta f}{2\pi(f_2-f_1)}\right]^2 \times N^2$$

to unity, where $(f_2-f_1)$ is very much greater than $2\Delta f$, for small N of less than 7 half cycles.

The high rejection of the pulse energy by the filter is due to the fact that short pulses of this nature are very rich in harmonics, as may be determined by a Fourier analysis of the pulses. When N increases to some twenty or thirty IF cycles, the harmonic content of the pulse decreases, and the IF filter passes more nearly the total pulse energy content. The quantities $\Delta t$ and N are both proportional to the ranges up to such a range that the propagation time $\Delta t$ becomes equal to T. Beyond this value the duration $\Delta t$, and consequently N, decrease, and reach zero for a range equivalent to a propagation time 2T. The total energy content of the pulse is proportional to its duration $\Delta t$, and to its intensity which latter falls off with the fourth power of range.

The operation of the fuze is, therefore, readily understood. When the range equals the point of $\Delta t=T$, all the energy of the received signal appears in the IF strip, and the response coincides with as the range law of propagation. For ranges below this optimum range, the response of the fuze increases only directly as the range, rather than as the fourth power of range, because the fuze response is proportional to the fourth power of range divided by the product of $N^2$ and $\Delta t$, both of which terms are proportional to range. Beyond this optimum range, without pretense of mathematical exactitude, it is evident that the pulse duration and N decrease with range, and the response falls off sharply inversely as the seventh power of range, all effects being contributory to the decrease. The response falls rapidly to the noise level. This provides the sharp range discrimination, approaching a step function, that is the purpose of the fuze.

The purpose of the gate 42 may now be visualized. Without this device, it will be seen that for a range equivalent to $\Delta t=T$ there would be a continuous IF frequency in time. As range increases, this continuous wave would be interrupted every half cycle by such a short time, that its Fourier analysis would not develop the high harmonic content required for the desired sharp break in response. By using the gate 42, the pulses are retained regardless of range, and no anomalous response occurs in the region of the optimum, by passing from a pulsed wave to a continuous wave.

Returning now to the progression of range discussed above, it will be evident that beyond a range equivalent to 2T, the same sequence of events will repeat. The response will increase to a minor, and undesired, value for 3T that will have a magnitude of $\frac{1}{3}$ to the fourth power, or slightly more than one-hundredth of the desired optimum. This may be objectionable as not allowing sufficient discrimination of targets: The fuze might trigger on a large target 16 beyond the effective burst range.

The range providing this spurious response may be increased, and consequently the magnitude of the spurious response greatly decreased by providing in the time 2T a plurality of frequency pulses of suitably chosen frequencies, all of equal duration. As an example, assume the time 2T is broken up into four periods in which the frequencies $f_1$, $f_2$, $f_3$, $f_4$ are transmitted in sequence, each lasting one quarter part of 2T. If these are now made such that $f_2-f_1=f_4-f_3=$IF frequency and $f_1<f_3<f_2<f_4$, and if the gate 42 is made to accept signals only during the transmission of the two higher frequencies $f_2$ and $f_4$, it will be found that optimum IF pulses occur for a range such that $\Delta t=\frac{1}{4}$ 2T and $\Delta t=5/4$ 2T. The fuze being designed for the first of these, the spurious response will be 1/5 raised to the fourth power as compared to $\frac{1}{3}$ to the fourth power when only two frequencies are used.

The four pulse discrimination is deemed adequate. In this case, it is evident that for the same optimum range the time 2T must be doubled. The effective IF pulse durations remain then exactly as they were for the two pulse system, and the operation remains the same except for the spurious signal level. The only complication introduced is in the coding of the square wave modulator 14, and a possible refinement of the gate sensitivity.

Obviously many modifications and variations of the present invention are possible in the light of the above teachings. It is, therefore, to be understood that within the scope of the appended claims the invention may be practiced otherwise than as specifically described.

What is claimed is:

1. A microwave proximity fuze for a missile, comprising, a radio transmitting-receiving system including a waveguide having at one end a klystron with a repeller electrode and an antenna at the other end thereof, means including a square wave modulator for sending a predetermined sequence of voltage pulses to the repeller of said klystron to produce corresponding but well-defined frequency changes in the output signals from said klystron, said output signals being transmitted through said waveguide and radiated by said antenna into free space and intercepted and reflected back to said antenna by a target, a pair of directional couplers, one of said couplers being responsive only to transmitted signals and the other said coupler being responsive to received signals reflected from said target, means including a balanced mixer having its input channels connected to receive said signals from said couplers, means including crystal detectors mounted in the output channels of said balanced mixer, means including an intermediate frequency amplifier for receiving the output signals from said crystal detectors, means including a diode for receiving a unidirectional voltage signal from said intermediate frequency amplifier, an auxiliary detector, a third directional coupler associated with said waveguide for transmitting outgoing signals to said auxiliary detector, said auxiliary detector producing a rectified transmitted signal, means including a gate electrically associated with said auxiliary detector and said diode as well as said square wave modulator to give a negative bias on the cathode of said diode, said bias on said cathode of said diode being determined jointly by the voltage derived from the rectified transmitted signal from said auxiliary detector and the voltage from said square wave modulated, and a firing circuit for said fuze including a squib and a thyratron tube having an anode, a cathode and a control grid for also receiving said negative bias, said thyratron causing detonation of said squib whenever the negative bias of said control grid becomes reduced sufficiently to permit a discharge to occur between its anode and cathode.

2. A microwave proximity fuze for a missile, comprising, a radio transmitting-receiving system including a waveguide having at one end a klystron with a repeller electrode and an antenna at the other end thereof, means including a square wave modulator with a multivibrator for sending a predetermined sequence of voltage pulses to the repeller of said klystron to produce corresponding but well-defined frequency changes in the output signals from said klystron, said output signals being transmitted through waveguide and radiated by said antenna into free space and intercepted and reflected back to said antenna by a target, a pair of directional couplers, one of said couplers being responsive only to transmitted signals and the other said coupler being responsive to received signals reflected from said target, means including a balanced mixer having its input channels connected to receive said signals from said couplers, means including crystal detectors mounted in the output channels of said balanced mixer, means including an intermediate frequency amplifier for receiving the output signals from said crystal detectors, means including a diode for receiving a unidirectional voltage signal from said intermediate frequency amplifier, a third detector, a third directional coupler associated with said waveguide for transmitting outgoing signals to said third detector, said third detector producing a rectified transmitted signal, means electrically associated with said third detector and said diode as well as said square wave modulator to give a negative bias on the cathode of said diode, said bias on said cathode of said diode being determined jointly by the voltage derived from the rectified transmitted signal from said third detector and the voltage from said square wave modulated, and a firing circuit for said fuze including a squib and a thyratron tube having an anode, a cathode and a control grid for also receiving said negative bias, said thyratron causing detonation of said squib whenever the negative bias of said control grid becomes reduced sufficiently to permit a discharge to occur between its anode and cathode.

3. A microwave proximity fuze for a missile, comprising, means for continuously generating oscillations of varying frequency, means for feeding a plurality of distinct voltage pulses, repeated indefinitely in the same sequence, to said first mentioned means to produce a corresponding periodic sequence of sets of oscillations of different frequencies, means including an antenna for radiating said sets of oscillations of different frequencies against a target, means for heterodyning said incoming reflections of said sets of oscillations of different frequencies with the outgoing sets of oscillations of different frequencies to produce oscillations of intermediate frequency from the outgoing oscillations of one of said frequencies and the reflections of another frequency, means including a diode for receiving said oscillations of intermediate frequency, a detector, means associated with said radiating means for transmitting outgoing signals to said detector, said detector producing a rectified transmitted signal, means electrically associated with said detector and said diode as well as said means for feeding a plurality of distinct voltages to give a negative bias on the cathode of said diode, said bias on said cathode of said diode being determined jointly by the voltage derived from the rectified transmitted signal from said detector and said feeding voltage means, and a firing circuit for said fuze including a squib and a thyratron tube having an anode, a cathode and a control grid for also receiving said negative bias, said thyratron causing detonation of said squib whenever the negative bias of said control grid thereof becomes reduced sufficiently to permit a discharge to occur between its anode and cathode.

4. A microwave fuze for detonating an explosive charge in proximity to a target, comprising, means for continuously generating microwave oscillations of varying frequency, means for feeding a plurality of distinct voltage pulses, repeated indefinitely in the same sequence, to said first mentioned means to produce a corresponding periodic sequence of sets of microwave oscillations of different frequencies, means including an antenna for radiating said sets of oscillations of different frequencies against a target, means for heterodyning incoming reflections from the target of said sets of oscillations of different frequencies with the outgoing sets of oscillations of different frequencies to produce oscillations of intermediate frequency, detonating means, means receiving said oscillations of intermediate frequency for initiating the action of said detonating means, a detector, means associated with said radiating means for transmitting outgoing signals to said detector, said detector producing a rectified signal proportional to the power of said radiated oscillations, and means receiving said detector signal for restraining the operation of said initiating means during such times as the power of said oscillations of intermediate frequency fails to exceed the power of the output of said detector.

5. A fuze as claimed in claim 4 wherein said last named means includes a gate circuit receiving both said detector signal and a portion of the output of said means for feeding a plurality of distinct voltage pulses.

6. A microwave proximity fuze comprising, a microwave oscillator, means for cyclically varying the frequency of the output of said oscillator to provide a plurality of distinct pulses of oscillations, the oscillations occurring in each pulse during a given cycle of said frequency varying means being separated in frequency from the oscillations of the preceding pulse by a fixed amount, an antenna for radiating the output of said oscillator and for receiving oscillations reflected by a target, a mixer for combining transmitted oscillations with received oscillations, an amplifier receiving the output of said mixer, said amplifier being tuned to the frequency equalling said fixed amount of frequency separating oscillations in successive pulses, means for detecting the output of said amplifier, firing means initiated by the output of said detection means, and means responsive to the relative power of transmitted and received signals for rendering said detection means inoperative below a certain relative power.

* * * * *